United States Patent [19]

Fujiwara et al.

[11] 4,419,861

[45] Dec. 13, 1983

[54] SPINNING APPARATUS PROVIDED WITH KNOTTING TRUCK

[75] Inventors: Michiaki Fujiwara, Kameoka; Makoto Uramoto, Kyoto, both of Japan

[73] Assignee: Murata Kikai Kabushiki Kaisha, Kyoto, Japan

[21] Appl. No.: 312,123

[22] Filed: Oct. 16, 1981

[30] Foreign Application Priority Data

Oct. 17, 1980 [JP] Japan ..... 55-145971

[51] Int. Cl.[3] ..... D01H 15/00; D01H 13/16; D01H 13/22

[52] U.S. Cl. ..... 57/261; 57/80

[58] Field of Search ..... 57/261, 263, 264, 80, 57/81, 78

[56] References Cited

U.S. PATENT DOCUMENTS

| | | | |
|---|---|---|---|
| 3,638,412 | 2/1972 | Rebsamen | 57/261 X |
| 3,899,868 | 8/1975 | Lee et al. | 57/261 |
| 4,030,281 | 6/1977 | Schopper et al. | 57/261 X |
| 4,176,514 | 12/1979 | Stalder | 57/261 |

*Primary Examiner*—Donald Watkins

*Attorney, Agent, or Firm*—Spensley, Horn, Jubas & Lubitz

[57] ABSTRACT

A spinning apparatus provided with a knotting truck moving along many spinning units. The knotting truck includes a yarn breakage detecting mechanism detecting a yarn breakage indicating plate of a unit where slub yarn breakage occures and a detecting mechanism detecting an impediment signal display plate of a unit where natural yarn breakage occurs. The knotting truck is only stopped at the position of the unit where slub yarn breakage occurs.

9 Claims, 22 Drawing Figures

SPINNING APPARATUS PROVIDED WITH KNOTTING TRUCK

BACKGROUND OF THE INVENTION

There is known a so-called pneumatic spinning apparatus in which a sliver is continuously supplied to a drafting device comprising a back roller, an apron and a front roller, the sliver is drafted at a predetermined ratio, the sliver is fed to an air jet nozzle generating a swirling air stream and a spun yarn is obtained by the swirling air stream.

In this spinning apparatus, many spinning units are arranged in parallel, and the respective units have no knotting means. There is known a knotting device which moves along spinning units in the longitudinal direction of the spinning apparatus and stops at a predetermined position of a yarn breakage-occurring unit to automatically perform a knotting operation.

More specifically, when such knotting truck stops at a predetermined position of a yarn breakage-occurring unit, the upper yarn on the feed side and the lower yarn on the package side are taken out and guided into a knotter disposed on the knotting truck to effect a knotting operation and the knotting truck then begins to move to a subsequent yarn breakage-occurring unit.

SUMMARY OF THE INVENTION

The present invention relates to a spinning apparatus. More particularly, the present invention relates to a spinning apparatus provided with a knotting or splicing truck.

Yarn breakage takes place when spinning becomes impossible because of winding of the sliver on a roller in the drafting zone or because of clogging of the air nozzle with the sliver or impurities contained in the sliver or when a sliver can becomes empty. In case of yarn breakage of this type, the broken yarn is gradually thinned in the cut end portion. Yarn breakage of this type is called "natural yarn breakage" in the instant specification.

In some cases, a slub catcher is arranged in a yarn path of the body portion of the spinning apparatus and when an abnormally thick part (slub) of the spun yarn passes, the slub catcher emits a mechanical or electric signal to forcibly cut the yarn. Yarn breakage of this type will be referred to as "slub yarn breakage" hereinafter.

In the case of "natural yarn breakage", splicing by the knotting operation of the knotting truck alone is impossible and an operator has to make such operation as exchange of an empty can with a full can and removal of the wound sliver.

An object of the present invention is to provide a spinning machine in which a knotting or splicing truck moving along spinning units detects the occurrence of yarn breakage in a certain spinning unit, discriminates "slub yarn breakage" from "natural yarn breakage", passes through the spinning unit in the case of "natural yarn breakage" but stops at the spinning unit in the case of "slub yarn breakage" to automatically perform the knotting or splicing operation.

The knotting truck of the present invention which travels along many spinning units includes a yarn breakage detecting mechanism detecting a yarn breakage indicating plate of a unit where slub yarn breakage occurs and a detecting mechanism detecting an impediment signal display plate of a unit where natural yarn breakage occurs. According to the present invention, when the yarn breakage indicating piece alone is detected, the knotting truck is stopped at the position of the unit where slub yarn breakage occurs and the knotting operation is performed and the knotting truck is then travelled at the normal direction. When the impediment signal display plate of a unit where natural yarn breakage occurs is detected, the knotting truck does not stop at this unit but passes through this unit. Therefore, according to the present invention, the knotting truck does not stop at a yarn breakage-occuring unit where knotting is impossible, but the knotting truck selectively stops at a yarn breakage-occuring unit where knotting is possible and performs the knotting operation. Therefore, the time of stoppage of the winding operation in the yarn breakage-occurring unit where knotting is possible can be shortened and the operation efficiency of the spinning apparatus as a whole can be enhanced. Furthermore, since the knotting operation is not tried in a unit where natural yarn breakage due to clogging of the nozzle with the sliver or winding of the sliver on the roller takes place, there is no risk of damage of the drafting device or air nozzle by further supply of the sliver.

DETAILED DESCRIPTION OF THE INVENTION

The present invention will now be described in detail with reference to embodiments illustrated in the accompanying drawings.

Figure 1:
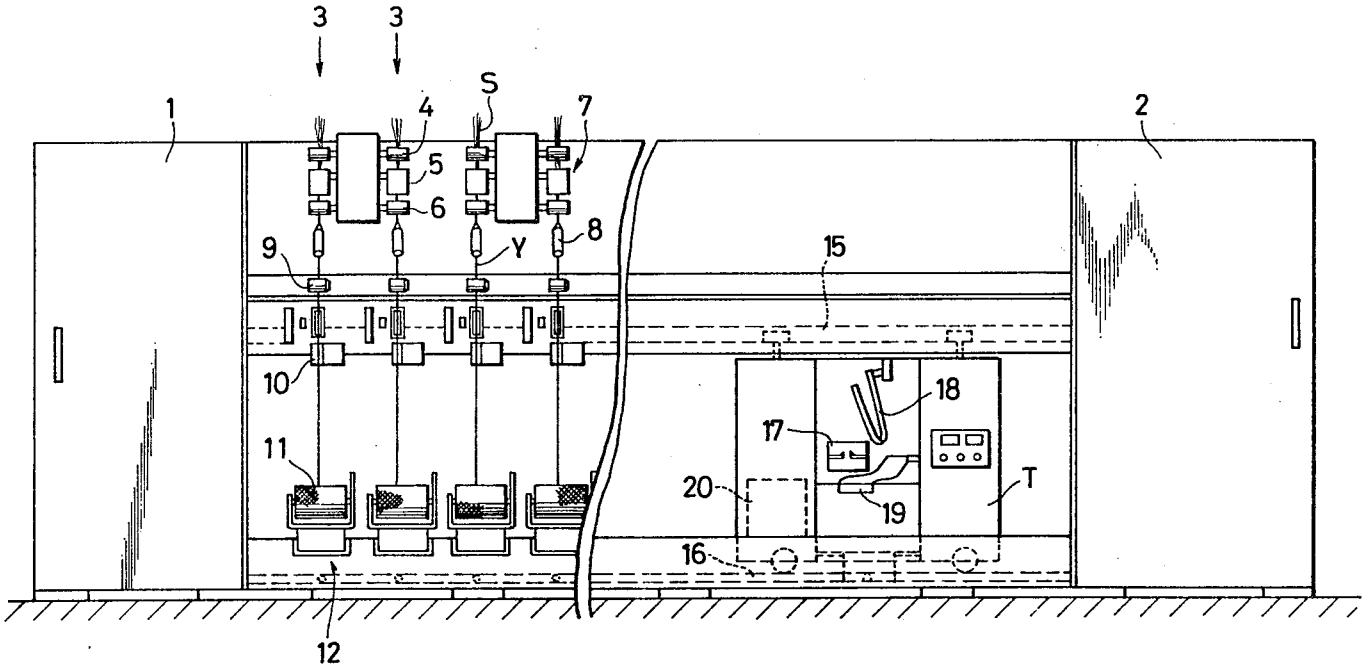
FIG. 1 is a schematic front view illustrating the relation between the body portion of the spinning apparatus and the knotting truck in the present invention.
Figure 2:
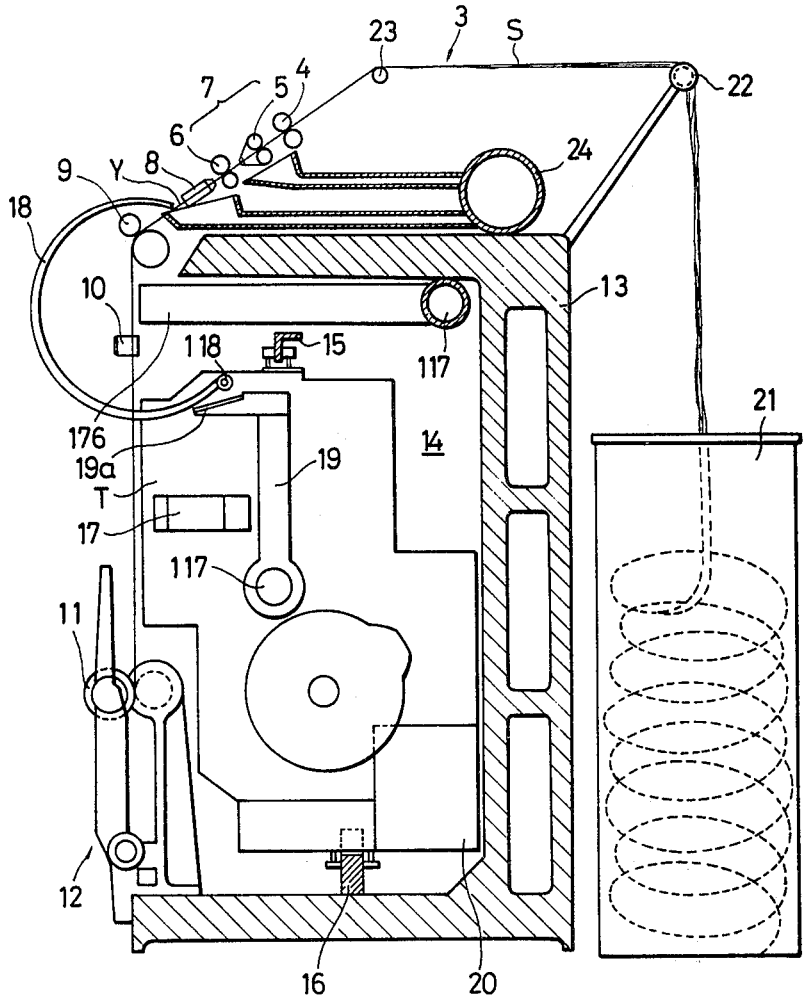
FIG. 2 is a side view showing the structure shown in FIG. 1.

Referring to FIGS. 1 and 2, many pneumatic spinning units 3 are arranged between a prime mover box 1 and a blower box 2. Each of the pneumatic spinning units 3 comprises a drafting part 7 including a back roller 4, a middle roller 5 and a front roller 6, an air jet nozzle 8, nip roller 9 for taking out a spun yarn Y formed by the nozzle 8, a slub catcher 10 for detecting a thick portion (slub) of the spun yarn and a winding part 12 for winding the yarn on a package 11 while traversing the yarn.

As shown in FIG. 2, the spinning unit is arranged on a frame 13 having a ]-shaped side section, and in an inner space 14 of the frame 13, a knitting or a splicing truck T described hereinafter moves right and left reciprocatively along rails 15 and 16.

The knotting or splicing truck T comprises a suction pipe 18 for sucking and holding the upper yarn on the feed side and guiding it to a knotter or a splicer 17 and a suction mouth 19 for sucking and holding the lower yarn on the package side and guiding it to the knotter or splicer 17. Both the suction pipe 18 and the suction mouth 19 are turnably mounted on the knotting or splicing truck T, and moreover, a blower 20 for generating a suction air stream is mounted on the knotting or splicing truck T.

Referring to FIG. 2, a sliver S to be fed to the drafting part 7 is taken out from a sliver can 21 disposed on the back of the machine, and is supplied to the back roller 4 through guide rollers 22 and 23. A discharge pipe 24 is laid out throughout all the spinning units to discharge fly wastes and dusts formed in the drafting part 7 and the air nozzle zone 8.

Figure 3:
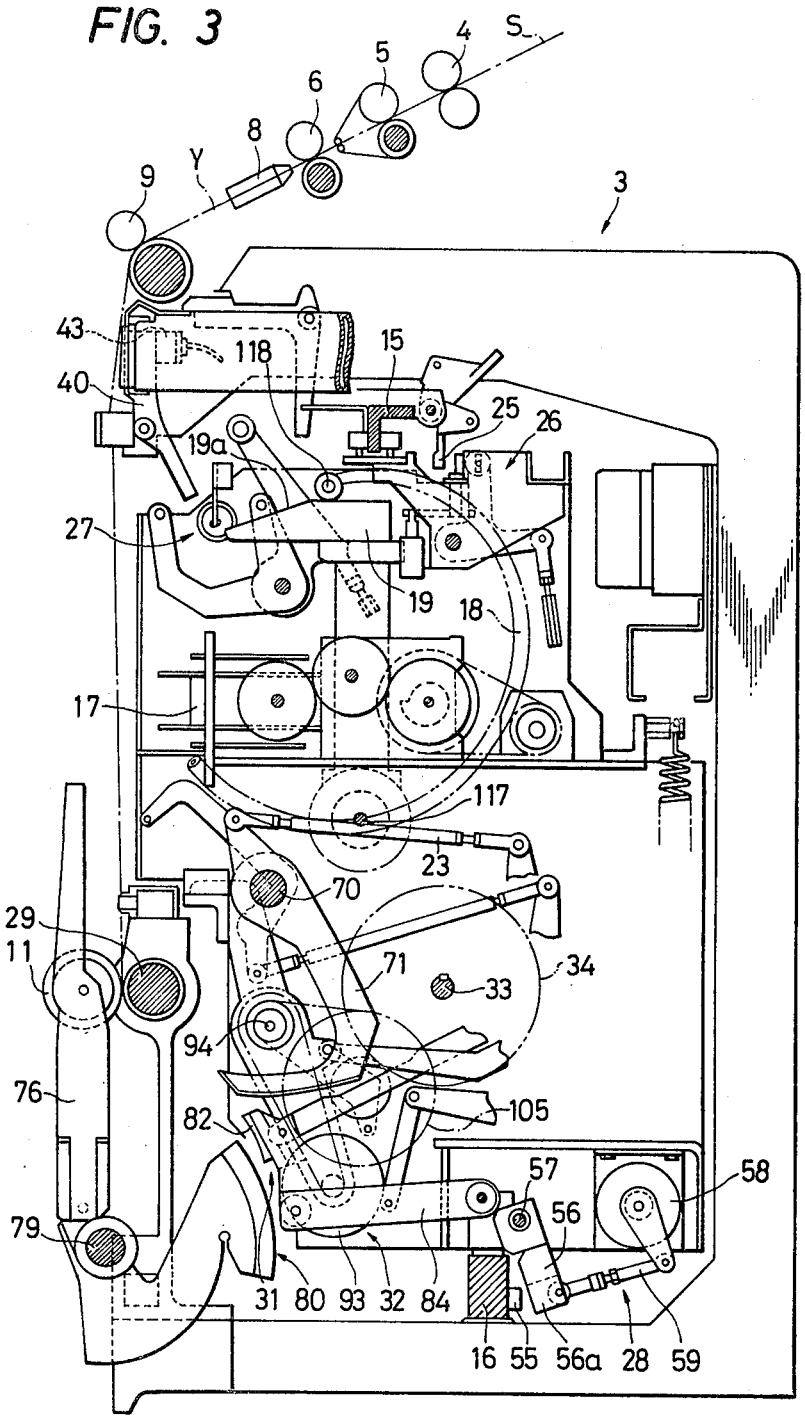
FIG. 3 is a side view diagrammatically illustrating the structure of the knotting truck.

FIG. 3 is a diagram showing the schematic structure of the knotting truck T and the relation between the knotting truck T and the body portion 3 of the spinning apparatus. In this embodiment the truck T is explained as to be a knotting device provided with a knotter. But the truck T may be a splicing one provided with a splicer which includes an air jetting nozzle.

Referring to FIG. 3, the knotting truck T comprises in the upper portion a yarn breakage detecting mechanism 26 detecting a yarn breakage indicating piece 25 of a yarn breakage-occurring unit and a natural yarn breakage-occurring unit detecting mechanism 27 and in the lower portion a stop mechanism 28 for stopping the truck T at a predetermined position of a yarn breakage-occurring unit.

Furthermore, the knotting truck T comprises a package push-out mechanism 30 for pushing a wound package 11 in a direction separating from a friction roller 29, a package positioning mechanism 31 for holding the package pushed out by said push-out mechanism 30 at a predetermined position and a package reversing mechanism 32 for reversing the package when the suction mouth takes out the lower yarn.

Moreover, the suction pipe 18 for sucking and holding the upper yarn on the feed side, the suction mouth 19 for sucking and holding the lower yarn on the package side and the knotter 17 are arranged on the knotting truck T.

The foregoing mechanisms are operated by many cam plates 34 fixed to a cam shaft 33.

The foregoing mechanisms will now be described in detail.

Figure 4:
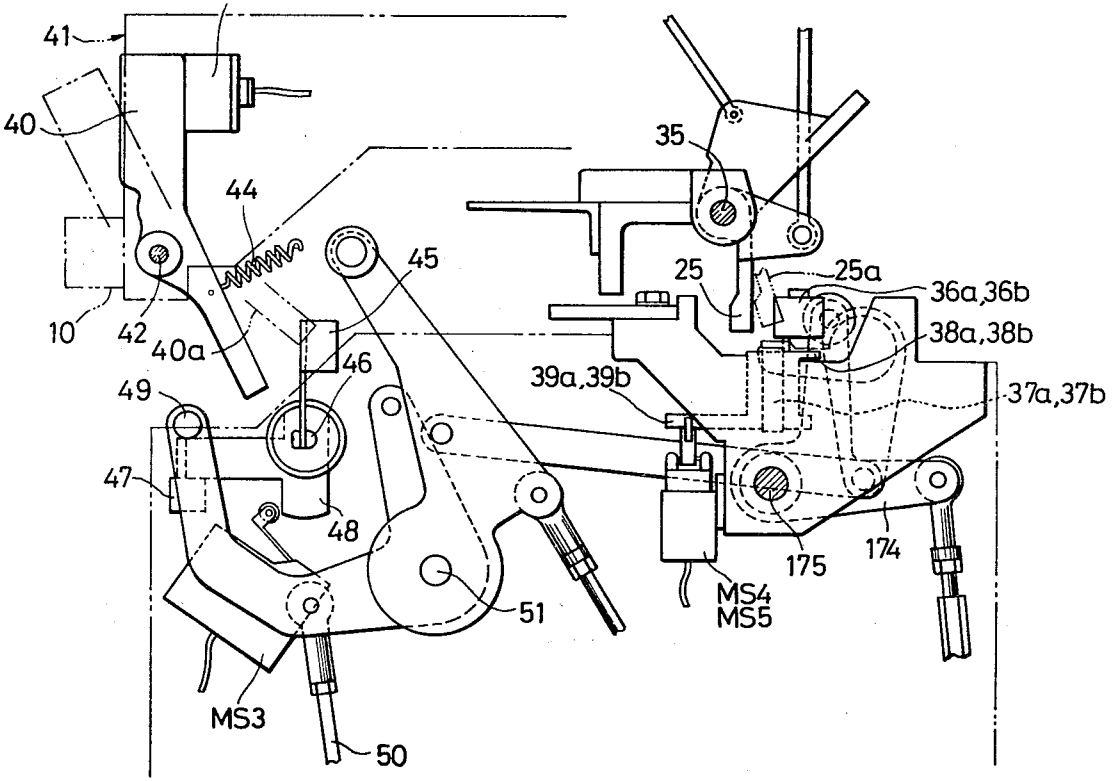
FIG. 4 is a side view showing the detecting mechanisms of detecting the yarn breakage indicating plate and impediment signal display plate of the spinning unit.

(A) Yarn Breakage Detecting Mechanism:

Referring to FIG. 4, in the spinning unit, a yarn breakage indicating piece 25 to be actuated on detection of yarn breakage by the slub catcher 10 is urged in the counterclockwise direction with a shaft 35 being as the fulcrum. When slub yarn breakage or natural yarn breakage takes place, the yarn breakage indicating piece 25 is displaced to a position **25*a* indicated by a two-dot chain line. In the knotting truck T, dogs 36*a* and 36*b* engageable with the displaced indicating piece 25 are mounted on levers 38*a* and 38*b* arranged rotatably around shafts 37*a* and 37*b*, so that when the dogs 36*a* and 36*b* are engaged with the displaced indicating piece 25, levers 39*a* and 39*b* integrated with the levers 38*a* and 38*b* are turned to kick a microswitch MS5. A pair of dogs 36*a* and 36*b*** and a pair of microswitches MS4 and MS5 are disposed so that one dog and microswitch are used while the truck moves to the right and the other dog and microswitch are used when the truck moves to the left.

An impediment signal display plate 40 indicating an impediment when natural yarn breakage other than slub yarn breakage occurs is pivoted on a shaft 42 so that it can project from or retreat below a cover 41 on the front face of the spinning unit 3. More specifically, in the normal state, the impediment signal display plate 40 is attracted and held onto an electromagnet 43 and when natural yarn breakage takes place, the electromagnet 43 is de-energized and the plate 40 is turned by a spring 44 in the counterclockwise direction with the shaft 42 being as the center of rotation and located at a position **40*a* indicated by a two-dot chain line. In the knotting truck T, a plate-like dog 45 engageable with the displaced display plate 40*a* is turnably pivoted on a shaft 46. In the normal state, the plate-like dog 45 is urged in a counterclockwise direction to a position indicated by a solid line by a spring (not shown) and held at this position by a stopper 47. When the dog 45 is engaged with the display plate 40*a*, the dog turns with the shaft 46 being as the center and a projection 48 on the other end of the dog 45 kicks a microswitch MS3 on the spinning unit side. A lever 49 is disposed to project the display plate 40 for the knotting operation in case of slub yarn breakage, and this lever 49 is turned by a rod 50 with a shaft 51** being as the center.

Figure 6:
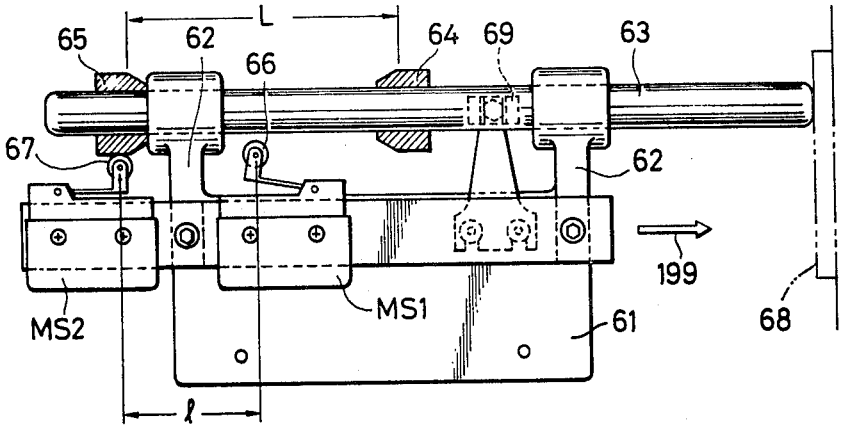
FIG. 6 is a front view illustrating the travel direction changeover mechanism mounted on the knotting truck.

(B) Mechanism for Moving and Stopping Knotting Truck:

Referring to FIG. 3 and FIG. 6 showing the bottom face of the knotting truck, a rail 16 is laid out on the machine stand and the knotting truck T is placed on the rail 16 through wheels 52 and moved by a driving motor M and a reduction gear 53.

Guide rollers 54 are disposed in contact with the sides of the rail 16, and a positioning pin 55 is fixed at a predetermined position of the spinning unit on the side of the rail 16 and a concave portion (56*a* in FIG. 3) of a positioning plate 56 mounted on the knotting truck T is engageable with this pin 55.

The positioning plate 56 is turnable with a shaft 57 being as the center. In the normal state, the plate 56 is held at a position indicated by a solid line and is not engaged with the pin 55. When the truck T is stopped, a rotary solenoid 58 is actuated by a stopping signal and the positioning plate 56 is turned in the clockwise direction in FIG. 3 by the operation of a rod 59 connected to the rotary solenoid 58 and is moved at a reduced speed while the guide face, except the concave portion, of the positioning plate 56 is kept in abutting contact with the pin 55. When this concave portion of the plate 56 arrives at the position of the pin 55, the concave portion is brought into engagement with the pin 55 by the urging force of the rotary solenoid 58, whereby the knotting truck is stopped.

Figure 5:
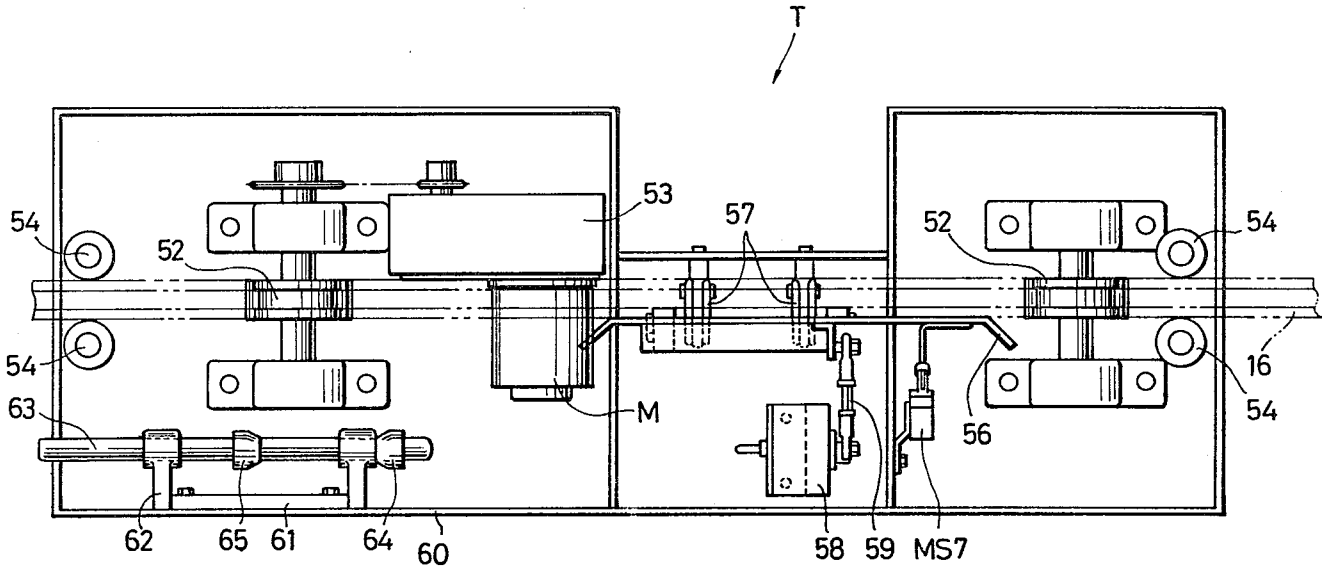
FIG. 5 is the bottom view of the knotting truck illustrating the travel stopping mechanism of the knotting truck.
Figure 7:
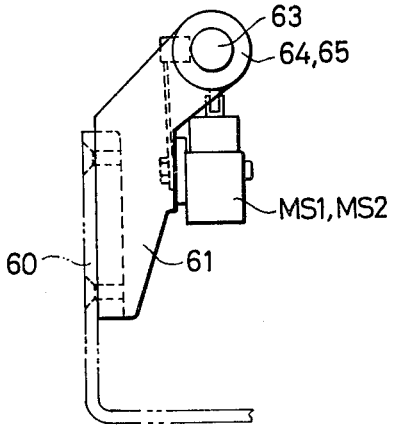
FIG. 7 is a side view showing the mechanism illustrated in FIG. 6.

Moving direction changeover microswitches MS1 and MS2 as shown in FIGS. 5, 6 and 7 are fixed to the truck T. More specifically, the microswitches MS1 and MS2 are secured to a bracket 61 fixed to a truck frame 60, and a rod 63 is slidably inserted and supported in the top ends of arms 62 of the bracket 61. Dogs 64 and 65 having a one side-inclined cylindrical shape and being engageable with the microswitches MS1 and MS2 are fixed to the intermediate portion of the rod 63.

The distance l between operating pieces 66 and 67 of the microswitches MS1 and MS2 is smaller than the distance L between the dogs 64 and 65. Accordingly, in the state shown in FIG. 6 where the dog 65 is engaged with the operating piece 67 of the microswitch MS2, if the truck is moved to the right, in the vicinity of the right end portion of the spinning apparatus, the right end portion of the rod 63 first abuts against a stopper 68 mounted in the spinning unit, and with further rightward movement of the knotting truck, the dog 65 separates from the microswitch MS2 and the truck moves at a reduced speed. Meanwhile, the operating piece 66 of the microswitch MS1 falls in engagement with the dog 64.

By this engagement of the operating piece with the dog, the rotation direction of the moving motor is reversed and the knotting truck is moved to the left. While the truck is moved to the left, the operating piece 66 is kept in engagement with the dog 64, and in the left end portion of the spinning apparatus, the moving direction is reversed by the operation contrary to the above-mentioned operation.

A pressing plate 69 is disposed to prevent accidental shifting of the rod 63, and while the knotting truck is moved, the plate 69 prevents the dog from separating from the microswitch.

Figure 8:
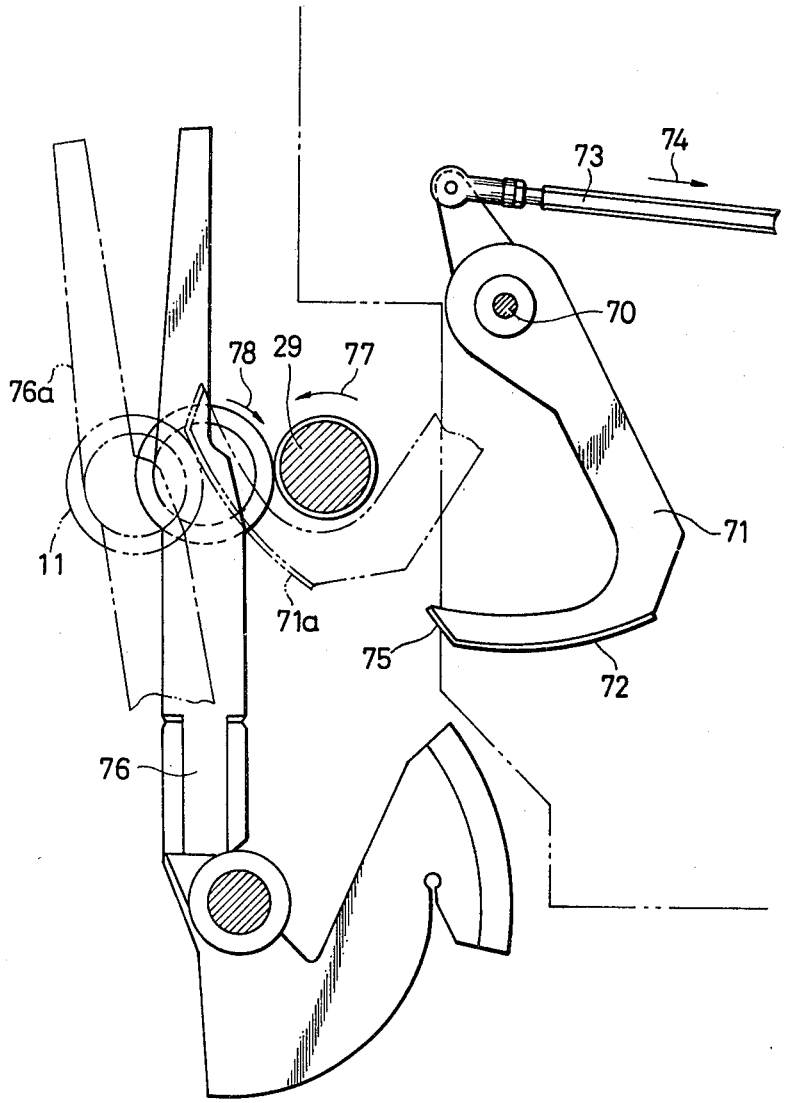
FIG. 8 is a side view illustrating the package push-out mechanism.

(C) Package Push-Out Mechanism:

Referring to FIGS. 3 and 8, a package push-out package plate 71 having a substantially L-figured shape is turnably supported on a stationary shaft 70 of the knotting truck. The contact surface 72 of the package plate 71, which falls in contact with the peripheral surface of the yarn layer on the package 11, is arcuate, and the center of the curvature of the arcuate shape of the contact surface 72 is in agreement with the center of the shaft 70.

The other end of the package plate 71 is connected to a rod 73 operated by rotation of cam plates 34, and when the rod 73 is moved in the direction indicated by an arrow 74, the package plate 71 is turned in the clockwise direction and the top end 75 of the contact surface 72 of the package plate 71 presses the peripheral surface of the yarn layer to push out a cradle 76 to a front position 76*a* indicated by a two-dot chain line. Incidentally, when the top end of the package plate 71 intrudes into the contact portion between the package and the friction roller 29, there is a risk of damage on the surface of the friction roller. Accordingly, the package plate is turned to such a position that the top end of the package plate is brought into contact with the yarn layer alone.

In the normal winding operation, the friction roller 29 is rotated in the direction indicated by an arrow 77 through all the spinning units. Accordingly, the package 11 is rotated in the direction indicated by an arrow 78 to wind the spun yarn thereon. When the package plate 71 acts on the package being thus rotated, the contact surface 72 is moved in the direction reverse to the rotation direction of the package, and therefore, the package plate has a braking action on the package to forcibly stop inertial rotation of the package.

A yarn end sucking attracting device is arranged on the knotting truck to be operated at the knotting operation. Since the package is pushed out by a constant distance irrespectively of the size of the package 11 by this device disposed on the knotting truck, the distance between the yarn end sucking device, that is, the suction mouth, and the package surface can always be kept constant.

Figure 9:
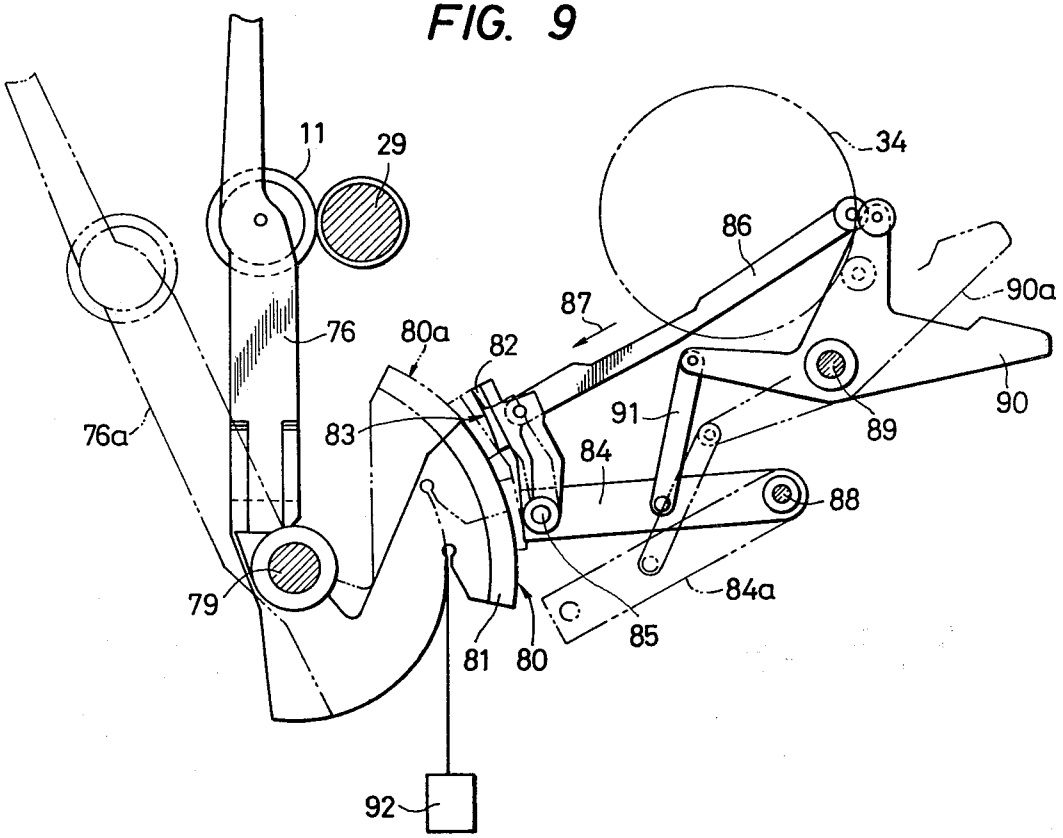
FIG. 9 is a side view illustrating the package positioning mechanism.

(D) Package Positioning Mechanism:

Referring to FIGS. 3 and 9, the cradle 76 is supported on the body portion of the spinning apparatus swingably with a stationary shaft 79 being as the center, and an arcuate shoe 80 with the shaft 79 being as the center is formed on the end portion of the cradle 76 and a rubber 81 is bonded to the shoe 80. A grip piece 82 has pressing contact with the shoe 80 and the contact surface 83 of the grip piece 82, falling in contact with the shoe 80, has a curved surface similar to the arcuate surface of the shoe 80 and the grip piece 82 adheres closely to the shoe 80. The grip piece 82 is turnable with a shaft 85 of a start lever 84 being as the center, and when a grip lever 86 is moved in the direction indicated by an arrow 87 by the action of the cam plates 34, the grip piece 82 is turned toward the cradle 76 with the shaft 85 being as the fulcrum and is brought into pressing contact with the shoe of the cradle 76*a* at the position indicated by a two-dot chain line when the package is pushed out forward.

The start lever 84 having the shaft 85 for turning the grip piece 82 is supported on the knotting truck rotatably around a shaft 88 and is connected through a lever 91 to a lever 90 which is turned with a shaft 89 being as the center by the cam plates. Accordingly, in the state where the grip piece 82 is kept in pressing contact with the shoe 80*a* of the cradle 76*a*, if the package plate 71 shown in FIG. 8 is returned to the original position, by rotation of the cam plates, the lever 90 is turned to the position 90*a* indicated by a two-dot chain line in FIG. 9 and by a weight 92 suspended from the cradle 76, the cradle 76 is returned to the position where the package 11 falls in contact with the friction roller 29.

At this point, the action line of the pressing force of the grip piece 82 to the surface of the shoe 80 deviates downward from the rotation center of the cradle 76 to generate the moment for turning the cradle 76 in the clockwise direction.

Accordingly, when the package is rotated again to start winding, pressing force slightly larger than the ordinary pressing force is imposed between the package and the friction roller, and a slip is prevented from occurring between the package and the friction roller.

Figure 10:
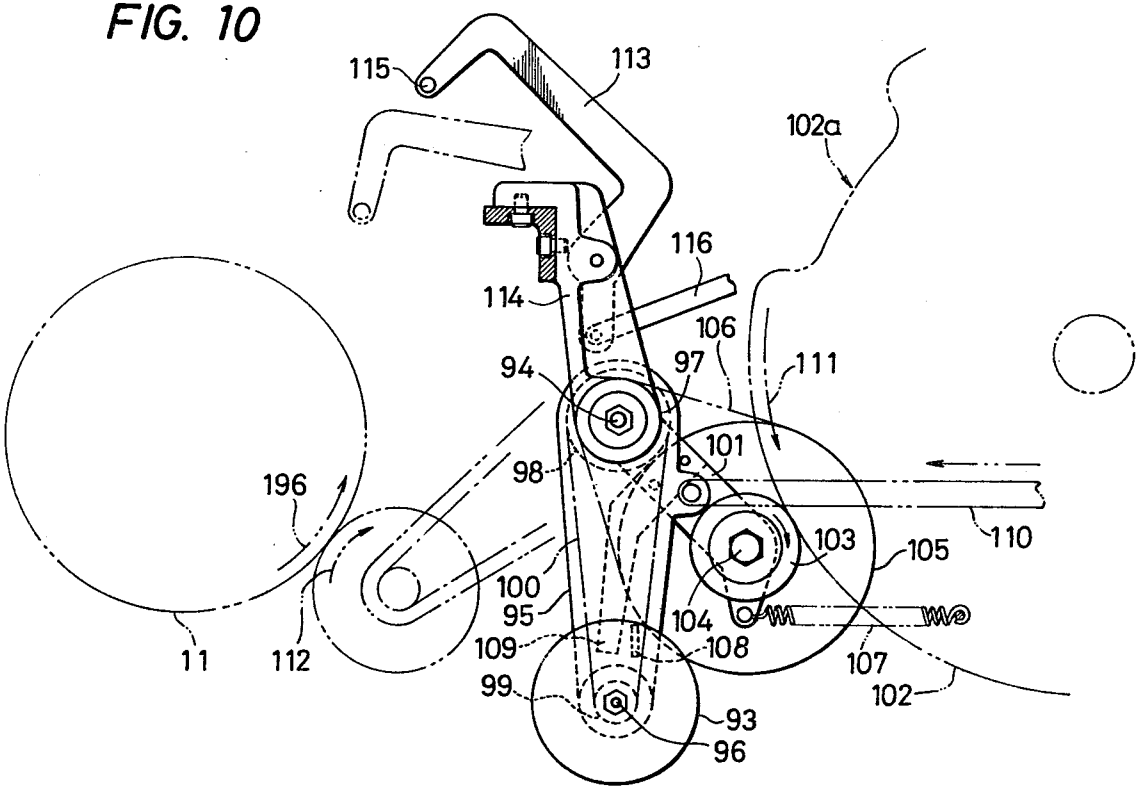
FIG. 10 is a side view showing the package reversing mechanism.

(E) Package Reversing Mechanism:

Referring to FIGS. 3 and 10, a package reversing roller 93 is secured to a shaft 96 on the top end of a swinging bracket 96 turnably supported on a stationary shaft 94 in the knotting truck. Sprockets 97 and 98 are integrally rotatably supported on the shaft 94, and a chain 100 is spread between the sprocket 98 and a sprocket 99 fixed to the shaft 96 of the swinging bracket 95. A bracket 101 is turnably supported on the shaft 94, and a cam roller 103 rotating in contact with a cam plate 102 is rotatably pivoted on the top end of the bracket 101 at a shaft 104. A sprocket 105 rotating integrally with the roller 103 is supported on the shaft 104, and a chain 106 is spread between the sprocket 105 and the sprocket 97.

The sprocket 101 is urged in the counterclockwise direction with the shaft 94 being as the center by a spring 107, and the cam roller 103 is rotated while having pressing contact with the peripheral face of the cam plate 102. A stop piece 109 secured to the bracket 101 abuts against a stopper 108, and this stopper 108 is secured at such a position that when the cam roller 103 arrives at a concave portion 102*a* of the cam plate 102, the roller 103 is kept separated from the peripheral face of the cam.

Accordingly, in the state where the package 11 is separated from the friction roller 29 as shown in FIG. 9, if a rod 110 connected to the swinging bracket 95 is moved to the left by the cam plate, the swinging bracket 95 begins to turn in the clockwise direction with the shaft 94 being as the center, and by rotation of the cam plate 102, the cam roller 103 having pressing contact with the peripheral face of said cam plate is rotated, whereby the sprocket 105, the chain 106, the sprockets 97 and 98 on the side of the shaft 94, the chain 100 and the sprocket 99 on the side of the swinging bracket 95 are turned and the package reversing roller 93 integrated with the sprocket 99 is rotated.

By rotation of the cam plate 102 in the direction of an arrow 111, the reversing roller 93 is rotated in the direction of an arrow 112 to rotate the package 11 pressed by the roller 93 in the direction opposite to the winding rotation direction, whereby unwinding of the yarn end can be facilitated.

Incidentally, a lever 113 is turnably supported on a stationary bracket 114 and has a yarn take-out guide rod 115 on the top end thereof, and the lever 113 is connected to a rod 116 operated by the cam plate. After the lower yarn on the package side is knotted with the upper yarn on the feed side by the knotter at the knotting step, the yarn take-out rod 116 takes out the yarn from the transverse guide until the normal winding operation is started again.

(F) Yarn End Sucking and Holding Mechanism:

Referring to FIGS. 2 and 3, the suction mouth 19 sucking and holding the lower yarn on the package side turns with a shaft 117 of the knotting truck being as the center, and the opening 19*a* of the suction mouth 19 is brought close to the surface of the yarn layer of the package at a position separated from the friction roller to suck and hold the yarn end from the package.

When the suction mouth sucking and holding the lower yarn is returned to the original position, the lower yarn connected to the package passes through the vicinity of the knotter 17.

The suction pipe 18 sucking and holding the upper yarn on the feed side is turnably supported on a stationary shaft 118 of the knotting truck T.

Figure 12:
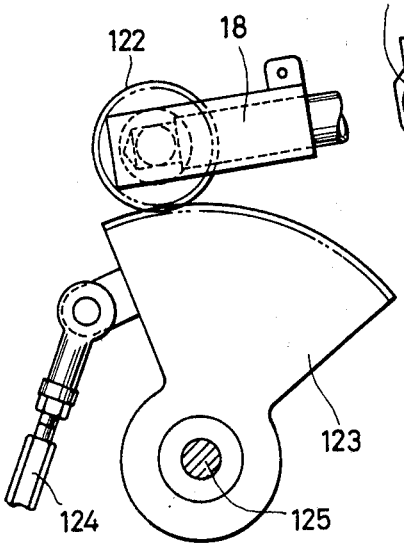
FIG. 12 is a side view illustrating the mechanism shown in FIG. 11.
Figure 11:
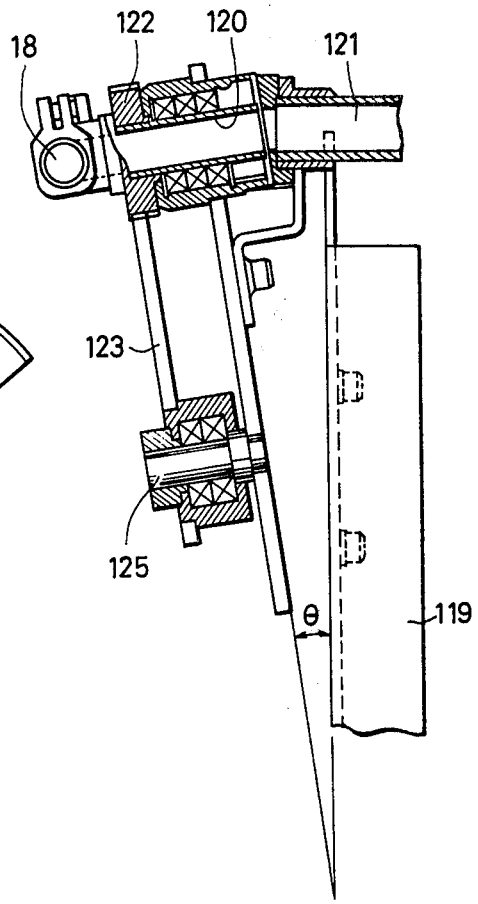
FIG. 11 is a sectional front view illustrating the suction pipe turning mechanism.

FIG. 3 illustrates the set position of the suction pipe 18 and FIG. 2 shows the position of the suction pipe 18 in the state where the suction pipe 18 sucks and holds the spun yarn. FIGS. 11 and 12 illustrate the mechanism for turning the above suction pipe.

A rotation shaft 120 for the suction pipe 18 is disposed in the vertical plane in the state inclined at an angle $\theta$ to a vertical stationary plate 119 of the knotting truck.

A suction pipe 121 is connected to the blower, and a gear 122 is secured to the fan-shaped hollow shaft 120 and the gear 122 is engageable with a fan-shaped gear 123. The suction pipe 18 is connected to the top end of the hollow rotation shaft 120, and when the fan-shaped gear 123 is turned with a shaft 125 being as the center by a rod 124 operated by the cam plate, the hollow rotation shaft 120 is rotated through the gear 122 and the opening of the suction pipe 18 is turned to the vicinity of the opening of the air nozzle 8 as shown in FIG. 2.

Figure 13:
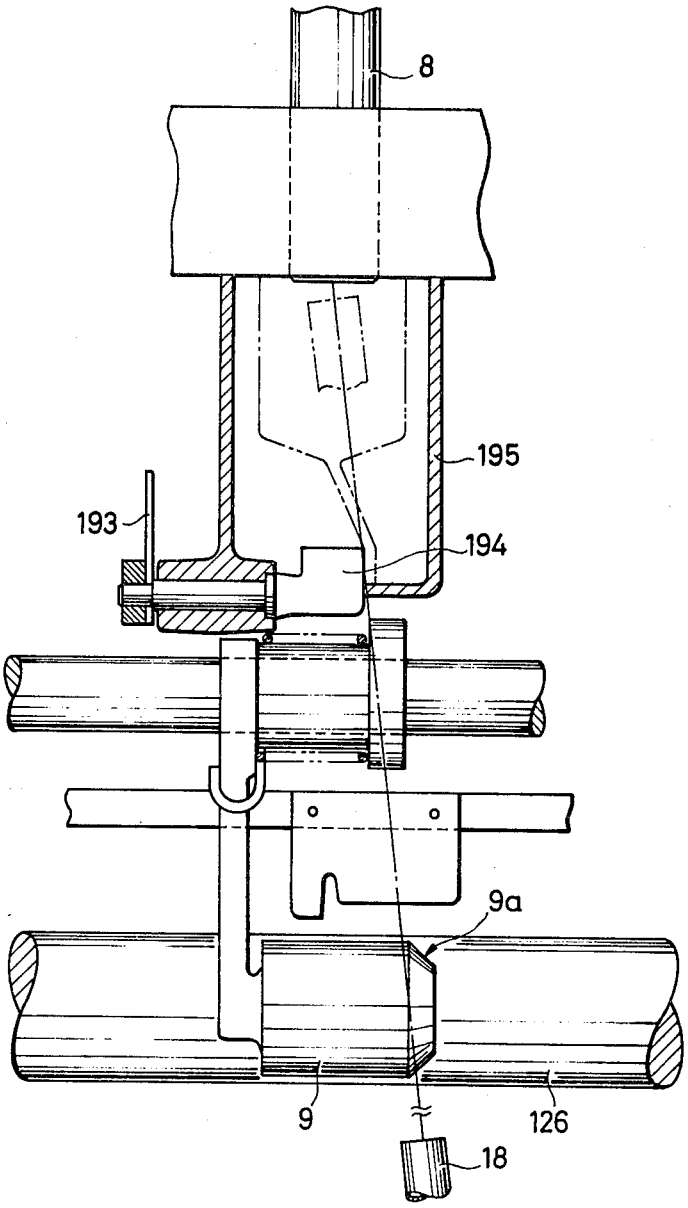
FIG. 13 is a plan view illustrating the positional relation between the upper yarn sucked and held by the suction pipe and the nip roller.

If the rotation shaft of the suction pipe 18 is inclined at an angle $\theta$ in the vertical plane as described above, when the suction pipe 18 sucking and holding the yarn spun from the nozzle 8 is returned to the original position, as shown in FIG. 13, the yarn between the nozzle 8 and the suction pipe 18 crosses slantingly the end face of the nip roller 9 and passes the nip roller 9 in this state, and when travelling of the yarn is started again after the knotting operation, the yarn falls on a delivery roller 126 through the inclined face 9*a* of the nip roller 9 and intrudes between the nip roller 9 and the delivery roller 126 and the yarn is automatically restored to the normal running position. Accordingly, the nipping operation can be accomplished without vertical or parallel movement of the suction pipe 18.

(G) Knotter and Yarn Guide Mechanism:

As the knotter for knotting the upper yarn and lower yarn, there may be used a known knotter for forming fisherman's knots or weaver's knots. As shown in FIG. 3, the knotter is disposed in the middle portion of the front face of the knotting truck.

Figure 14:
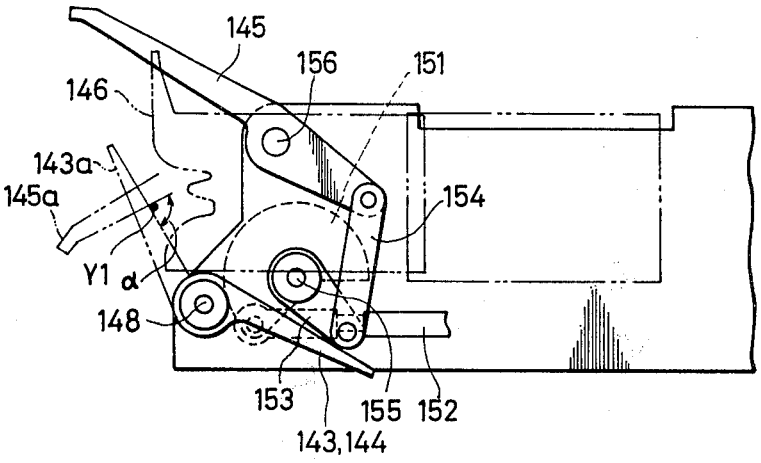
FIG. 14 is a plan view showing the mechanism for operating the guide lever of the knotter.
Figure 15:
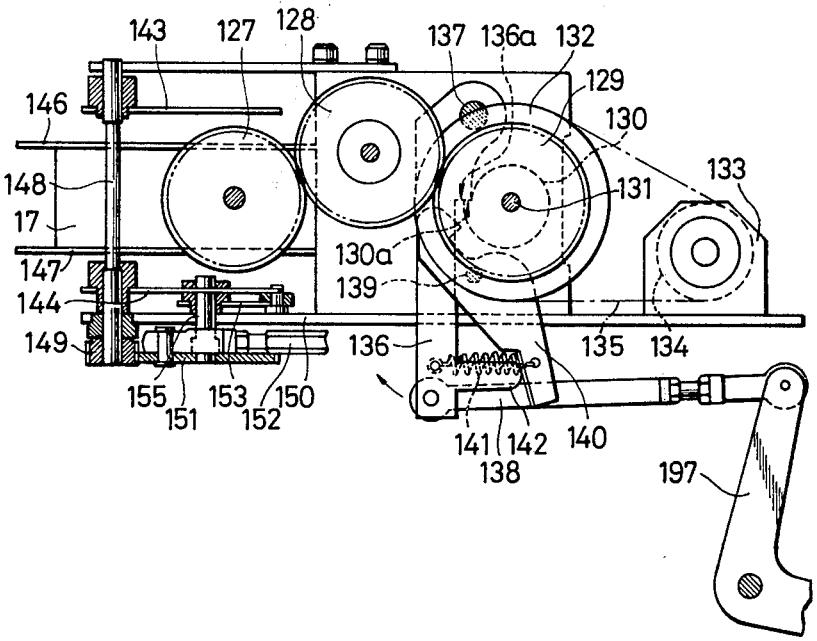
FIG. 15 is a partially sectional side view showing the mechanism for operating the knotter.

Referring to FIGS. 14 and 15 which are plan and side views of the yarn guide mechanism, a gear 127 operating the knotter is engaged with a gear 129 through an intermediate gear 128, and the gear 129 is integrated with a trip plate 130 and freely fitted on a shaft 131.

A sprocket 132 is secured to the shaft 131 through a friction clutch (not shown) and is co-operated with a sprocket 134 of a motor 133 through a chain 135. A projection 136*a* of a lever 136 is engaged with a step portion 130*a* of the trip plate 130.

The lever 136 is supported on a stationary shaft 137 so that it can be swung with the shaft 137 being as the center by the action of an operating rod 138. An anchoring lever 140 is freely fitted on a stationary shaft 139 at such a position that the trip plate 130 is stopped after it makes substantially one rotation, and the anchoring lever 140 is always urged to the direction abutting against the peripheral face of the trip plate 130. A stopper 142 for the anchoring lever 140 is secured to or formed on the lever 136.

By the leftward movement of the rod 138, the projection 136*a* of the lever 136 is disengaged from the step portion 130*a* of the trip plate 130, and rotation of the sprocket 132 is transmitted to the gear 129 to rotate the knotter operating gear 129 through the intermediate gear 128. When the gear 129 makes substantially one rotation, the step portion of the trip plate becomes engaged with the anchoring lever 140 to stop rotation of the gear 129 and stop the knotter, whereby the knotting operation is completed.

Guiding of the yarn to the knotter 17 is accomplished by guide levers 143 and 144 arranged above and below the knotter, a guide lever 145 disposed on the lower side of the knotter and guide plates 146 and 147 secured to the upper and lower ends of the knotter.

The guide levers 143 and 144 are secured to a vertical shaft 148, and a gear 149 is secured to the lower end portion of the shaft 148. The gear 149 is engaged with a fan-shaped gear 151 pivoted on a supporting plate 150, and a rod 152 operated by the cam is connected to one end of the fan-shaped gear 151. A lever 153 is secured to the shaft to which the fan-shaped gear 151 is secured, and the lever 153 is connected to the end portion of the guide lever 145 through a connecting lever 154.

When the rod 152 is pulled to the right, the fan-shaped gear 151 is turned, and the upper and lower guide levers 143 and 144 are turned through the gear 149 in the clockwise direction in FIG. 14 and the lower lever 145 is turned through the shaft 155 of the fan-shaped gear 151 with a shaft 156 being as the fulcrum in the clockwise direction, whereby the upper and lower yarns are guided into the knotter.

At this time, the yarn Y1 guided along the guide lever 145 is guided from the different guide lever **143*a* from the position shown in FIG. 14 to the knotter while being slid on the lever 145*a*. In this case, if the crossing angle between the guide levers 145*a* and 143*a* is small, since the yarn is moved in the state pressed to the guide face of the lever 145*a*, fluffs are formed and the yarn properties are degraded. Accordingly, the crossing angle between the levers 143 and 145 is increased when the yarn is brought into contact with the crossing portion of the levers 143 and 145**, so that the yarn slides lightly on the guide face. The crossing angle is preferably an obtuse angle, but the crossing angle may be an angle approximating to 90°.

The foregoing mechanisms are those attached to the knotting truck. Mechanisms mounted on the body portion of the spinning apparatus will now be described.

Figure 16:
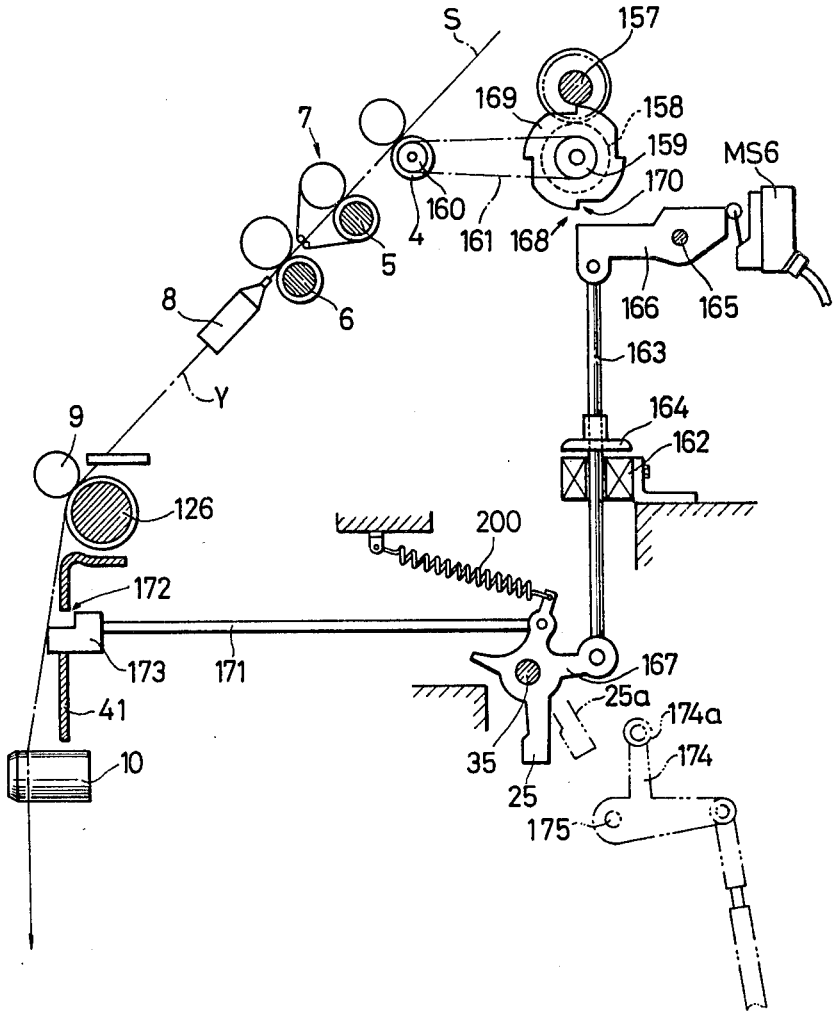
FIG. 16 is a schematic side view showing the mechanism for operating the yarn breakage indicating plate and the mechanism for stopping supply of sliver.

(H) Silver Supply Stopping Mechanism:

Referring to FIG. 16, the drafting device 7 comprises a back roller 4, a middle roller 5 and a front roller 6 and is mounted on each spinning unit, and a silver drafted at an appropriate drafting ratio is supplied to the air nozzle 8 by the front roller and subjected to the action of a swirling air stream, whereby a spun yarn Y is formed. The spun yarn is wound on the winding device located in the lower portion of the unit through the nip roller 9 and slub catcher 10.

Each of the middle roller 5 and front roller 6 of the drafting device comprises a line shaft passing through all the units or a plurality of units, but one back roller 4 is independently disposed for each unit. The movement of the back roller is transmitted between a pulley 159 and a pulley 160 on the back roller side via a belt 161 through an electromagnetic clutch gear 158 by a line shaft passing through all the units or a plurality of units.

The electromagnetic clutch is turned on and off by a microswitch MS6. Reference numeral 162 represents a magnet. An iron disc 164 is secured to a rod 163 piercing the magnet 162, a dog 166 freely fitted to a stationary shaft 165 is connected to the upper end of the rod 163, and the lower end of the rod 163 is freely fitted to the stational shaft 35, urged by a spring 200 and connected to a lever 167 forming the yarn breakage indicating piece 25.

In the normal spinning state, the yarn passes through the slub catcher 10 and the magnet 162 is excited by a signal indicating travel of the yarn, that is, a yarn presence signal, and the iron disc 164 is attracted and held onto the magnet 162 and the rod 163 is located at a lower position (indicated by a solid line). The microswitch MS6 is kept engaged with the dog 166, that is, in the "on" state, and supply of the silver is continued.

When slub yarn breakage or natural yarn breakage takes place, the slub catcher 10 detects non-travel of the yarn and emits a yarn absence signal, by which the magnet 162 is de-energized and the lever 167 is turned in the counterclockwise direction by the force of the spring 200. Accordingly, the rod 163 is lifted up to an upper position, and the lever engaging top end portion 168 is secured to the pulley 159 and is intruded in and engaged with a notch 170 of a stop plate 169 rotated integrally with the pulley 159 to stop the pulley 159. Accordingly, the back roller 4 rotated via the belt 161 is stopped to stop supply of the silver.

Incidentally, when the rod 163 is lifted up, by turning of the dog 166 on the top end of the rod 163, engagement between the dog 166 and the microswitch MS6 is released to turn off the microswitch MS6, whereby the electromagnetic clutch 158 is de-energized and transmission of the power to the pulley 159 from the line shaft 157 is cut.

A manual operation rod 171 has one end connected to the lever 167 and a press piece 173 having a step 172 formed thereon is secured to the other end of the rod 171. When yarn breakage takes place, the press piece 173 is projected to the left beyond a cover 41 for the front face of the body portion, and when spinning is started again by the manual operation, the press piece 173 is depressed, whereby the lever 167 is turned in the clockwise direction through the rod 171 and the rod 163 is forcibly located at the lower position. Accordingly, the microswitch MS6 is turned on to actuate the electromagnetic clutch 158 and the back roller 4 is rotated to start supply of the silver again.

When re-start of spinning is automatically performed, a turning lever 174 mounted on the knotting truck is turned in the counterclockwise direction with a shaft 175 being as the center to return the yarn breakage indicating piece 25 to the position indicated by a solid line from the position **25*a* indicated by a two-dot chain line, whereby the lever 167** is turned to re-start spinning.

Figure 17:
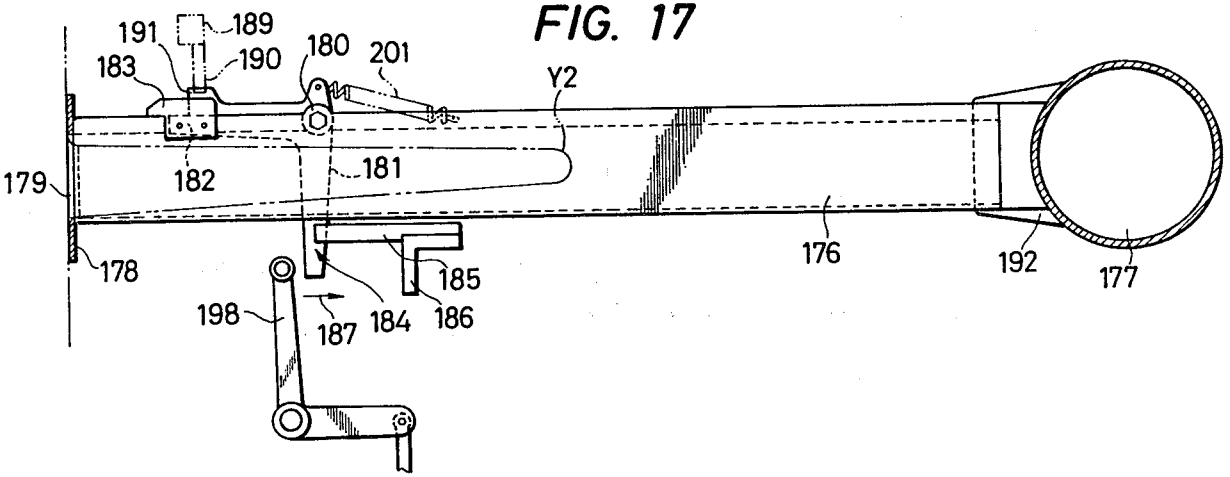
FIG. 17 is a side view showing the mechanism for operating the slack removing tube.
Figure 18:
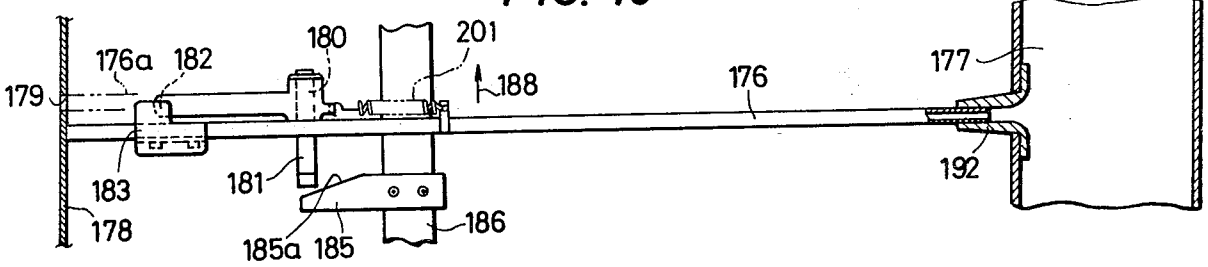
FIG. 18 is a plan view illustrating the mechanism shown in FIG. 17.

(I) Mechanism for Removing Slack on Upper Yarn:

Referring to FIGS. 2, 17 and 18, a slack removing tube 176 disposed below the nip roller 9 has a rectangular shape and a thin section and is connected to a suction pipe 177 piercing through all the spindles. The opening on the top end of the tube 176 abuts against the back face of a shutter 178 secured to the body portion. A hole 179 is formed on the shutter 178 so that when the slack removing tube is displaced in the lateral direction, this hole 179 is in agreement with the opening of the slack removing tube 176. Ordinarily, the hole 179 deviates from the opening of the tube 176 to shield the running yarn from the sucking action.

The slack removing tube 176 is secured to a horizontal shaft 180 and a substantially L-shaped lever 181 is swingably pivoted on the shaft 180. A spring 201 is laid out between the lever 181 and the slack removing tube 176 and the lever 181 is urged in the clockwise direction with the shaft 180 being as the center. The top end 182 of the lever 181 abuts against a stopper piece 183 of the slack removing tube 176 to effect positioning of the lever 181. In the vicinity of the lower and portion 184 of the lever 181, a horizontal cam plate 185 capable of being engaged with the lower end portion 184 by turning around the shaft 180 of the lever 181 is secured to a supporting plate 186. If the lever 181 receives a turning action in the direction indicated by an arrow 187 in FIG. 17, the lower end portion 184 of the lever 181 moves along the cam face 185*a*. Accordingly, the slack removing tube 176 as a whole is turned in the direction indicated by an arrow 188 in FIG. 18 with the joint portion of the suction pipe 177 being as the center and the opening of the tube 176 is shifted to a position 176*a* indicated by a two-dot chain line, whereby the opening of the tube 176 is communicated with the hole 179 of the shutter 178. This movement is accomplished in a moment substantially simultaneously with the knotting operation by the knotter, and the upper yarn Y2 spun at the knotting operation is sucked and stored in the slack removing tube 176 as shown in FIG. 17 and when winding is started again after the knotting operation, the stored yarn Y2 is gradually taken out and wound without slacking.

Return of the slack removing tube to the original position is accomplished by a projecting piece 190 secured to a traverse bar 189 always changing the yarn path of the nip roller.

More specifically, by engagement of a projection 191 of the lever 181 with the projection 190 of the traverse bar 189, the slack removing tube 176 is pushed to the original position. In the state where the lever 181 is turned and engaged with the cam plate 185, that is, while the yarn is sucked, the projection 191 is located below the projecting piece 190 and is prevented from being engaged with the projecting piece 190.

Incidentally, the slack removing tube 176 is connected to the suction pipe 177 through a flexible tubular member 192 and is slightly swingable in the direction indicated by the arrow 188 with this joint portion being as the center. The slack removing tube 176 is urged toward the shutter 178 by a spring (not shown). The slack removing tube 176 is held at the above-mentioned two positions by the frictional force between the top end face of the opening of the tube 176 and the back face of the shutter 178.

The operations of the apparatus of the present invention will now be described.

As described hereinbefore, yarn breakage in the spinning unit includes positive yarn breakage by slub and natural yarn breakage which occurs when the nozzle is clogged with sliver or a sliver can becomes empty.

In the apparatus of the present invention, the knotting truck passes through a unit where natural yarn breakage takes place and indicates that knotting in the unit is impossible. Only in case of slub yarn breakage, the spinning unit where yarn breakage occurs is detected. Each case will now be described.

Figure 19:
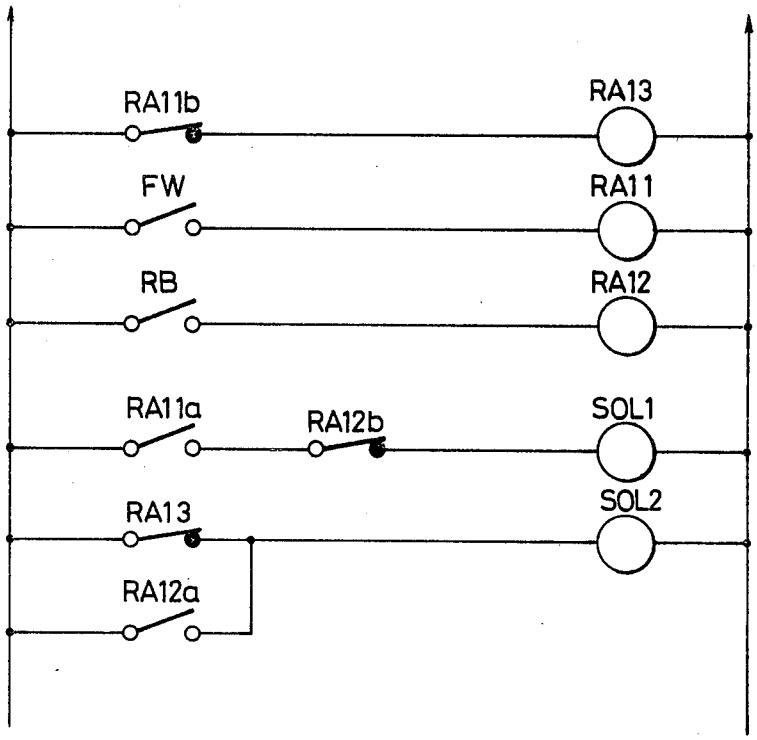
FIG. 19 is a sequence circuit diagram showing the circuit for operating the yarn breakage indicating plate and the impediment signal display plate.

(A) In Case of Natural Yarn Breakage:

While spun yarn is travelling, the yarn passes through the slub catcher, and therefore, the presence of the yarn in the slub catcher is detected and a yarn presence signal is emitted. In this state, a switch FW shown in FIG. 19 is put on and hence, a relay RA11 is excited to close a contact RA11*a*. Moreover, a spinning solenoid relay SOL1 is excited and the magnet 162 shown in FIG. 16 continues to attract the iron disc 164, and spinning is continued. When natural yarn breakage takes place, since the yarn presence signal is not emitted any longer, the contact FW is turned off and the relay RA11 is de-energized. Accordingly, the contact RA11*a* is opened to de-energize the magnet 162, and the rod 163 shown in FIG. 16 is raised to the upper position and rotation of the back roller is stopped, whereby supply of the sliver is stopped and the spinning operation is stopped. Simultaneously, by de-energization of the relay RA11, a contact RA11*b* is closed, and a relay RA13 is turned on and a contact RA13 is opened, whereby impediment signal relay SOL2 is turned off. Accordingly, the magnet 43 shown in FIG. 4 is de-energized, and the impediment signal display plate 40 which has been attracted and held by the magnet 43 is turned in the counterclockwise direction with the shaft 42 being as the center by the force of the spring 44, and the top end of the display plate 40 projects from the front face of the body portion of the unit to inform an operator that natural yarn breakage takes place in the unit.

At this time, as shown in FIG. 4, both the yarn breakage indicating piece 25 and the impediment display plate 40 are located at the positions indicated by two-dot chain lines. Accordingly, when the knotting truck reaches this unit, although the operating piece of the microswitch MS3, MS4 or MS5 is pressed, in case of natural yarn breakage, even if the splicing truck is stopped, knotting is impossible. The knotting truck, therefore, is arranged so that the knotting truck does not stop at this natural yarn breakage-occurring unit.

Figure 20:
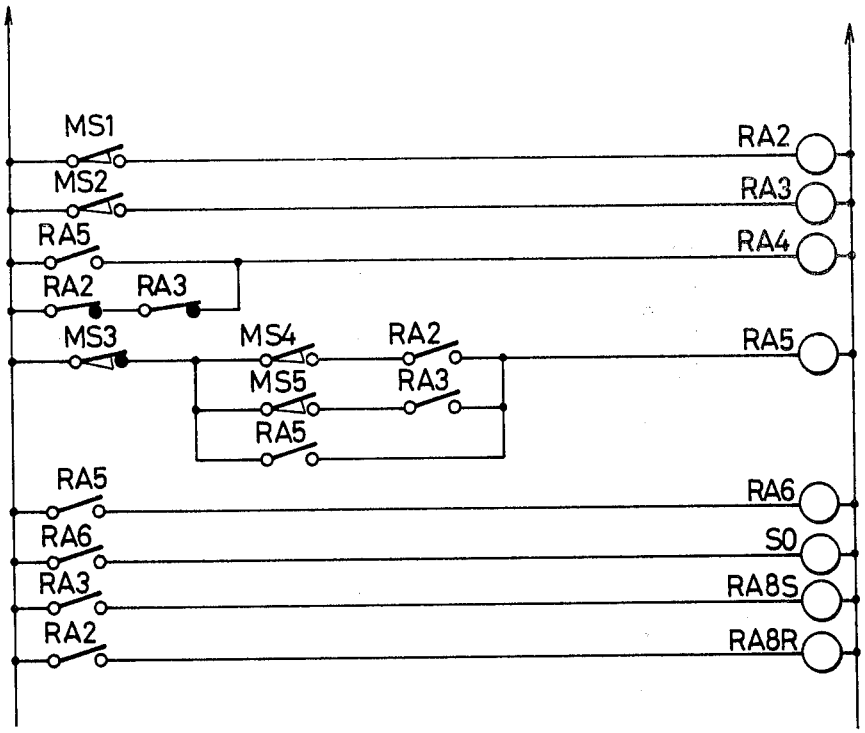
FIG. 20 is a sequence circuit diagram showing the circuit for instructing the stopping and direction changeover of the knotting truck.

Referring to FIG. 20, switches MS1 and MS2 indicate the switches MS1 and MS2 shown in FIG. 6, and while the knotting truck is being moved, any one of the switches is kept in the "on" state.

The switch MS3 is a switch sensing the impediment signal display plate shown in FIG. 4, and the switches MS4 and MS5 are switches sensing the yarn breakage indicating piece. The switches MS4 and MS5 are spaced from each other in the direction perpendicular to the paper surface in FIG. 4, and these switches are arranged so that when the switch on the side of the travelling direction of the knotting truck is turned on, the travelling speed of the knotting truck is reduced.

Figure 21:
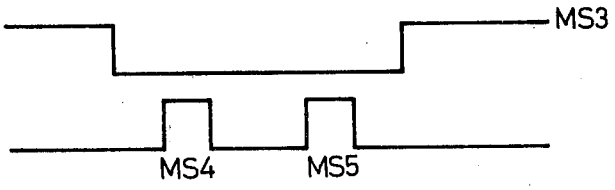
FIG. 21 is a diagram illustrating the positional relationship between the microswitch for detecting the yarn breakage indicating plate and the microswitch for detecting the impediment signal display plate.

The positional relationship among the switches MS3, MS4 and MS5 is such that as shown in FIG. 21, the switches MS4 and MS5 are arranged within the operation range of the switch MS3.

In case of natural yarn breakage, since the impedement signal display plate 40 shown in FIG. 4 projects, the switch MS3 of the running knotting truck is actuated, and in FIG. 20, the contact *b* (MS3) is opened and therefore, even if the switch MS4 or MS5 to be turned on by engagement with the yarn breakage indicating piece is turned on, a speed-reducing relay RA5 is not excited and the knotting truck continues running at a constant speed.

(B) In Case of Slub Yarn Breakage:

When a thick portion (slub) is present on spun yarn, the quantity of light detecting the presence of the yarn is changed in the slub catcher 10, whereby slub is detected and a slub signal is emitted.

A contact RB in FIG. 19 is closed by the slub signal and a relay RA12 is excited. Accordingly, a contact RA12*b* is opened and the relay SOL1 is de-energized, and the magnet 162 shown in FIG. 16 is turned off and the iron disc 164 which has been attracted to the magnet 162 is separated from the magnet 162 by the force of the spring 167, whereby the rod 163 is raised to the upper position and the spinning operation is stopped. Simultaneously, by the turning movement of the lever 167, the rod 193 (see FIG. 13) connected to the lever 167 is actuated and the yarn between the air nozzle 8 and the nip roller 9 is cut between the blade face and the top face wall of a nozzle box 195 by the turning movement of a cutter 194.

Referring to FIG. 19 again, the cutter is actuated by excitation of the relay RA12, and for performing cutting of yarn, the yarn presence signal is put off, the contact FW is opened, the relay RA11 is de-energized, the contact RA11*b* is opened and the relay RA13 is excited. Accordingly, the contact RA13 is opened but since the contact RA12*a* is closed by the relay RA12, the impediment signal relay SOL2 is kept excited. Namely, the magnet 43 shown in FIG. 4 is kept actuated to hold attraction of the impediment signal display plate 40. Therefore, the display plate 40 is inhibited from projecting.

Figure 22:
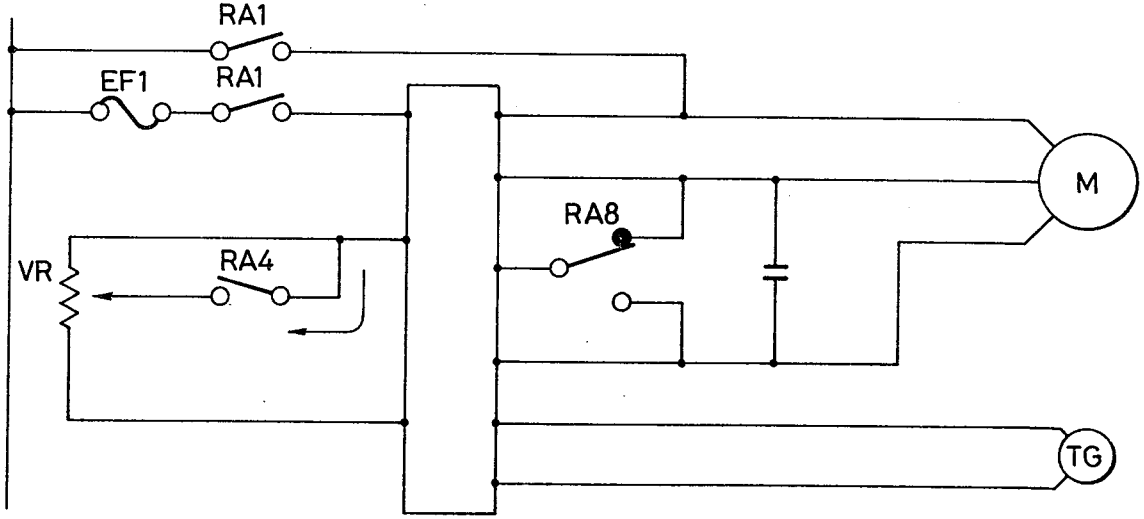
FIG. 22 is a sequence circuit diagram showing the circuit for reducing the speed of the driving motor and reversing the rotation direction of the driving motor.

Accordingly, a relay RA4 is excited through the contact RA5, whereby the contact RA4 shown in FIG. 22 is turned on and the moving motor M is rotated at a low speed through a variable resistance VR. Accordingly, the knotting truck comes into the reduced speed travelling. Simultaneously, by excitation of the relay RA5, a relay RA6 is excited through the contact RA5 and a solenoid relay SO is excited through the contact RA6, whereby the rotary solenoid 58 shown in FIGS. 3 and 5 is actuated to turn and press the positioning plate 56 toward the pin 55 on the rail 16.

During reduced speed travelling of the knotting truck, the concave portion of the positioning plate 56 is fitted with the pin 55, whereby the knotting truck T is stopped at a predetermined position in the yarn breakage-occurring unit.

When the positioning plate 56 is fitted with the pin 55, a microswitch MS7 shown in FIG. 5 is actuated, and the motor M is stopped through a circuit (not shown). Simultaneously, a cam motor is driven to drive the cam shaft 33 shown in FIG. 3, whereby the cam plates 34 are rotated to start the knotting operation.

(C) Knotting:

At first, the suction pipe 18 shown in FIG. 1 is turned to the position shown in FIG. 2. Namely, the opening of the suction pipe 18 is located in the vicinity of the yarn outlet of the air nozzle 8.

Separately, the lever 174 shown in FIGS. 4 and 16 is turned in the counterclockwise direction with the shaft 175 being as the center, and the yarn breakage indicating piece 25 is returned to the position indicated by the solid line from the position indicated by the two-dot chain line and this position is maintained by the pressing action of the roller 174*a* on the top end of the lever 174. Accordingly, a microswitch MS6 is turned on through the rod 163 by the lever 167, and the back roller 4 is driven to feed the sliver S and start spinning again. The spun yarn is sucked by the suction pipe 18 standing by at the outlet of the nozzle 8, and subsequently, by the turning movement of the suction pipe 18, the upper yarn is guided to the knotter 17.

Take-out of the lower yarn will now be described. At first, referring to FIG. 8, the package plate 71 is turned forward by the rod 73 and advanced to the position 71*a* indicated by a two-dot chain line to separate the package 11 from the friction roller 29. Subsequently the grip piece 82 shown in FIG. 9 is advanced to press the package 11 to the shoe 80 of the cradle 76 and hold it at a predetermined position. The package plate 71 is returned to the original position and the suction mouth 19 is turned in the counterclockwise direction with the shaft 117 being as the center to bring the suction opening close to the surface of the package.

In the state where the sucking action is imposed on the surface of the package, the reversing roller 93 shown in FIG. 10 is brought into contact with the surface of the package, and the package 11 is turned in the direction indicated by an arrow 196 and the suction mouth searches for the yarn end and suck and holds the lower yarn.

Subsequently, by return of the suction mouth 19 to the original position, the lower yarn is guided to the knotter 17 while being taken out from the package.

When the upper and lower yarns are guided to the knotter zone, the guide levers 143, 144 and 145 shown in FIGS. 14 and 15 are actuated to guide the upper and lower yarns to a predetermined position of the knotter 17 along the guide faces of the levers.

When the upper and lower yarns are guided into the knotter 17, by counterclockwise turning of the lever 197 shown in FIG. 15, the lever 136 is turned in the direction indicated by the arrow and the step portion is disengaged from the trip plate 130, and rotation of the motor 133 is transmitted and the knotter operating gear 127 makes substantially one rotation to effect knotting. Incidentally, the lever 198 shown in FIG. 17 in the direction indicated by the arrow 187 cooperatively with the turning movement of the lever 136, whereby the lever 181 pivoted on the slack removing tube 176 is brought into engagement with the cam plate 185 and the slack removing tube 176 is displaced to the position 176*a* indicated by the two-dot chain line in FIG. 18, with the result that the opening of the tube 176 is communicated with the hole 179 of the shutter 178, and the upper yarn spun even during the knotting operation is sucked and stored in the slack removing tube 176.

When the knotting operation by the knotter 17 is completed, the suction pipe 18, suction mouth 19 and guide levers 143, 144 and 145 are returned to the original positions and the start lever 84 shown in FIG. 9 is turned to the position 84*a* indicated by the two-dot chain line to return the cradle 76 to the original position. Simultaneously, the contact pressure of the package 11 to the friction roller 29 is increased for initiation of winding so that the package is prevented from slipping on the friction roller at the re-start of winding.

When winding of the yarn is started again, since the yarn passes through the slub catcher 10 shown in FIG. 16, the yarn presence signal is detected and the magnet 162 is excited by the circuit shown in FIG. 19 to hold the rod 163 at the lower position. Then, the lever 174 which has pressed the yarn breakage indicating piece 25 is returned to the original position.

When the knotting operation is thus completed in the slub yarn breakage-occurring unit, the knotting truck begins to run again.

More specifically, if a microswitch is disposed at such a position that when the cam shaft 33 makes substantially one rotation, the cam shaft 33 actuates the microswitch, the rotary solenoid shown in FIG. 3 is turned off and the driving motor M is driven by the microswitch.

(D) Travelling of Knotting Truck:

The running knotting truck is stopped at a yarn breakage-occurring unit in the above-mentioned manner. The operation of travelling the knotting truck at the turning portion will now be described.

Referring to FIGS. 6 and 20, supposing that the knotting truck is running in the direction indicated by an arrow 199 in FIG. 9, in the vicinity of the right end portion of the body portion of the spinning apparatus, the rod 63 of the truck abuts against the stopper 68 secured to the apparatus side.

The truck further continues to move rightward, and the microswitch MS2 soon separates from the dog 65, whereby the switch MS2 shown in FIG. 20 which has been in the "on" state is turned off and the contact "b" (OA3) which has been in the "off" state is turned on through the relay RA3, with the result that the relay RA4 is excited and the contact "a" (RA4) shown in FIG. 22 is closed, and the motor M comes into the low speed rotation. The truck T runs at a low speed, and when the microswitch MS1 shown in FIG. 6 falls in engagement with the dog 64, the switch MS1 is turned on to excite the relay RA2 and turn off the contact "b" (RA2), whereby the contact "a" (RA4) shown in FIG. 22 is turned off again through the relay RA4 and the low speed rotation of the motor M is changed to the normal speed rotation again.

Incidentally, by excitation of the relay RA2, the contact "a" (RA2) for a keep relay RA8R is turned on to excite the keep relay RA8R, and the contact "b" (RA8) shown in FIG. 22 is changed over to reverse the rotation direction of the motor M.

Also in the left end portion of the truck, the rotation direction is reversed in the same manner as described above.

Thus, the speed of the knotting trick T is reduced in the terminal turning portion, and after turning, the truck immidiately runs at the normal speed and the shock given to the truck in the turning portion is moderated.

What is claimed is:

1. A spinning apparatus provided with a knotting truck moving along many spinning units, said knotting truck comprising a knotter, a yarn breakage detecting mechanism detecting a yarn breakage indicating piece located on each spinning unit where yarn breakage due to slub occurs and a mechanisn detecting a impediment signal display plate located on each spinning unit where natural yarn breakage occurs, wherein when slub yarn breakage indicating piece alone is detected, the knotting truck stops at the position of the spinning unit and performs a knotting operation and when the impediment signal display plate of the spinning unit where natural yarn breakage occurs is detected, the knotting truck does not stop at the position of said spinning unit but passes through said spinning unit.

2. A spinning apparatus provided with a knotting truck as claimed in claim 1, wherein in the spinning unit, the yarn breakage indicating piece to be actuated on detection of yarn breakage by a slub catcher is provided to be engageable with dogs of the knotting truck to kick microswitches for detecting the yarn breakage indicating piece when slub yarn breakage or natural yarn breakage takes place and the impediment signal display plate indicating impediment when natural yarn breakage other than slub yarn breakage occures is provided pivotably on a shaft to be engageable with a plate-like dog of the knotting truck which kicks a microswitch for the impediment signal display plate according the turning motion thereof.

3. A spinning apparatus provided with a knotting truck as claimed in claim 2, wherein the microswitches for detecting the yarn breakage indicating piece are arranged within the operation range of the microswitch for the impediment signal displaying plate so that in case of natural yarn breakage the knotting truck continues running at a constant speed without stopping.

4. A spinning apparatus provided with a knotting truck as claimed in claim 3, wherein in case of slub yarn breakage, the impediment signal display plate is inhibited from projecting, because impediment signal relay is kept excited and the microswitches for the yarn breakage indicating piece is actuated so that the knotting truck comes into the reduced speed travelling and then a positioning plate provided at the lower face of the knotting truck is pressed toward a pin on a rail to stop the knotting truck at a predetermined position in the yarn breakage-occurring unit for the knotting operation.

5. A spinning apparatus comprising:

a knotting or splicing truck arranged to move along a plurality of spinning units;

a yarn breakage indicator on each of said spinning units, said yarn breakage indicator being actuated upon detection of slub yarn breakage and natural yarn breakage;

an impediment signal display means on each of said spinning units, said impediment signal display means being actuated upon detection of natural yarn breakage;

a first microswitch on said truck for detecting actuation of said yarn breakage indicator;

a second microswitch on said truck for detecting actuation of said impediment signal display means, said first microswitch being arranged within the operation range of said second microswitch;

wherein in the case of natural yarn breakage the truck continues to move along said spinning units at a constant speed.

6. A spinning apparatus as in claim 5 further comprising;

a first dog on said truck, said first dog being engagable with said yarn breakage indicator;

a second dog on said truck, said second dog being engagable with said impediment signal display means;

whereby engagement of said first dog with said yarn breakage indicator triggers said first microswitch and engagement of said second dog with said impediment signal display means triggers said second microswitch.

7. A spinning apparatus as in claim 5, wherein activation of said first microswitch by a slub yarn breakage in one of said spinning units causes said truck to move at a reduced speed of travel and to stop at a predetermined position facing said unit where said slub yarn breakage has occurred.

8. A spinning apparatus comprising:

a plurality of yarn spinning units;

a yarn joining device arranged to travel to each of said yarn spinning units;

a first yarn interruption indicator means on each of said spinning units for generating a first signal in response to the occurrence of natural yarn breakage in said spinning unit;

a second yarn interruption indicator means on each of said spinning units for generating a second signal in response to the occurrence of slub yarn breakage in said spinning unit;

a first detection means on said yarn joining device responsive to said first signal;

a second detection means on said yarn joining device responsive to said second signal; and control means on said yarn joining device for controlling the travel of said yarn joining device in response to said first and second signals, whereby said yarn joining device will stop at those spinning units at which slub yarn breakage has occurred and will bypass those spinning units at which natural yarn breakage has occurred.

9. A spinning apparatus comprising:

a plurality of yarn spinning units;

a yarn joining device arranged to travel to each of said yarn spinning units;

a first means on each of said spinning units for generating a first signal in response to the occurrence of a first type of yarn breakage in said spinning unit;

a second means on each of said spinning units for generating a second signal in response to the occurrence of a second type of yarn breakage in said spinning unit;

control means on said yarn joining device for controlling the travel of said yarn joining device in response to said first and second signals, whereby said yarn joining device will stop at those spinning units at which said first type of yarn breakage has occurred and will bypass those spinning units at which said second type of yarn breakage has occurred.

* * * * *